US005216192A

United States Patent [19]

Barker

[11] Patent Number: 5,216,192

[45] Date of Patent: Jun. 1, 1993

[54] STRING INSTRUMENT BRIDGE APPARATUS

[76] Inventor: Allen R. Barker, 270 Washington St., Wabash, Ind. 46992

[21] Appl. No.: 685,889

[22] Filed: Apr. 16, 1991

[51] Int. Cl.[5] ..... G10D 3/18

[52] U.S. Cl. ..... 84/328

[58] Field of Search ..... 84/290, 293, 314 R

[56] References Cited

U.S. PATENT DOCUMENTS

| | | | |
|---|---|---|---|
| 636,692 | 11/1899 | Patch | 84/328 |
| 823,657 | 6/1906 | Willis | 84/328 |
| 1,179,499 | 4/1916 | Bohmann | 84/328 |
| 1,713,855 | 5/1929 | Oettinger | 84/328 |
| 3,783,731 | 1/1974 | Pash | 84/173 |

*Primary Examiner*—William M. Shoop, Jr.
*Assistant Examiner*—Jeffrey W. Donels
*Attorney, Agent, or Firm*—Leon Gilden

[57] ABSTRACT

A string instrument, such as a guitar or banjo for example, mounts the bridge organization defined by an elongate planar body plate orthogonally mounted to an upper planar surface of the string instrument body, and includes a support plate fixedly mounted to the bridge at an orthogonal relationship relative to the planar bridge body. A modification of the invention includes the support plate pivotally mounted, with a top surface including an abrasive plate and a bottom surface including a wax bar for providing enhanced sensitivity for increased lubricity to an individual's fingers. A further modification of an aspect of the invention includes a unitary construction that is interfitted to the bridge organization prior to its mounting to the top surface of the string instrument body.

2 Claims, 5 Drawing Sheets

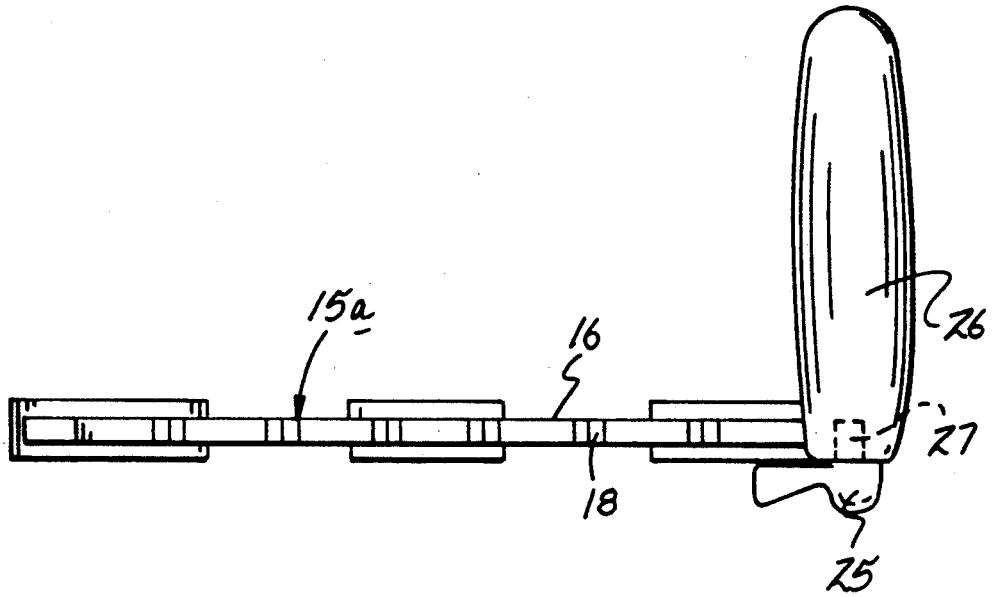
FIG 4
FIG 5
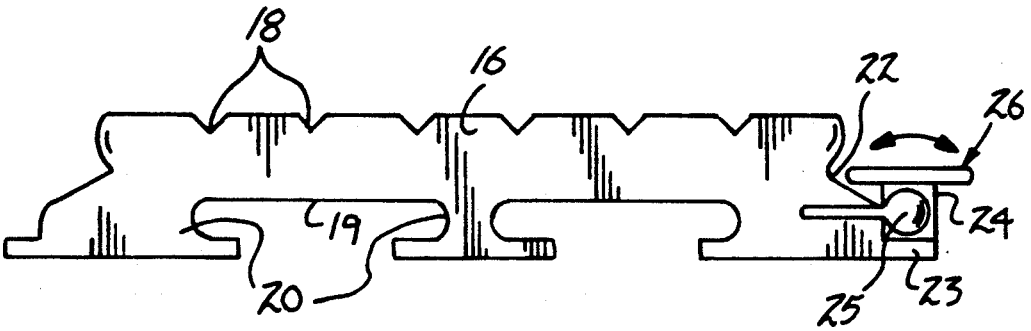

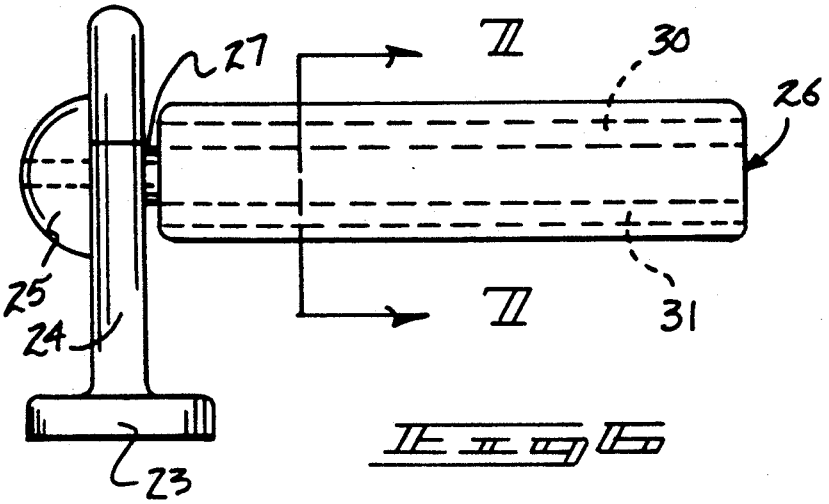
FIG 6
FIG 7
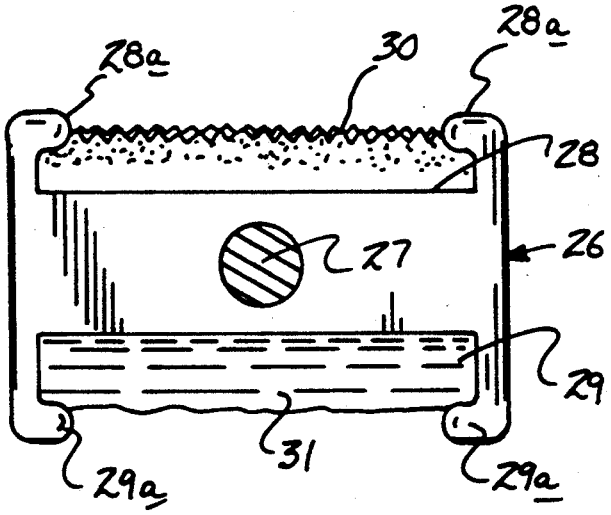

STRING INSTRUMENT BRIDGE APPARATUS

BACKGROUND OF THE INVENTION

1. Field of the Invention

The field of invention relates to string instruments, and more particularly pertains to a new and improved string instrument bridge apparatus wherein the same provides for a finger rest adjustably mounted relative to the fret structure for providing enhanced positioning of an individual's fingers for resting and proper orientation of the fingers for enhanced musical playing in a training and playing procedure.

2. Description of the Prior Art

Various string instruments are utilized in the prior art, wherein the use of such instruments involves the agility, mobility, and training of the fingers of the playing hand to be positioned in a proper orientation relative to the associated string members of the instrument. Various instruments of the prior art are exemplified in use for various environments and are exemplified by U.S. Pat. No. 4,037,510 to Ginex, et al. wherein the apparatus or method are illustrated for refinishing a finger board fret of a stringed instrument.

U.S. Pat. No. 4,753,147 to Berardi sets forth a guitar mute formed of a tubular body of elasticized terry cloth material for muting the strings during playing and mounted in a surrounding relationship relative to the neck of a stringed instrument.

U.S. Pat. No. 4,509,399 to McKibben sets forth a vibration dampener or a mute for use of a string instrument.

U.S. Pat. No. 4,739,689 to Cacioppo, et al. sets forth a thumb rest for a musical instrument, wherein a plate member is mounted to a top surface of the string instrument spaced from the fret and string members thereof.

As such, it may be appreciated that there continues to be a need for a new and improved string instrument fret apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of string instrument bridge apparatus now present in the prior art, the present invention provides a string instrument bridge apparatus wherein the same utilizes a fret construction adjustably mounted in an orthogonal relationship relative to an associated fret member of a string musical instrument. As such, the general purpose of the present invention, which will be described subsequently in greater detail, is to provide a new and improved string instrument bridge apparatus which has all the advantages of the prior art string instrument fret apparatus and none of the disadvantages.

To attain this, the present invention provides a string instrument, such as a guitar or banjo for example, mounting the fret organization defined by an elongate planar body plate orthogonally mounted to an upper planar surface of the string instrument body, and includes a support plate fixedly mounted to the bridge at an orthogonal relationship relative to the planar bridge body. A modification of the invention includes the support plate pivotally mounted, with a top surface including an abrasive plate and a bottom surface including a wax bar for providing enhanced sensitivity for increased lubricity to an individual's fingers. A further modification of an aspect of the invention includes a unitary construction that is interfitted to the bridge organization prior to its mounting to the top surface of the string instrument body.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved string instrument bridge apparatus which has all the advantages of the prior art string instrument bridge apparatus and none of the disadvantages.

It is another object of the present invention to provide a new and improved string instrument bridge apparatus which may be easily and efficiently manufactured and marketed.

It is a further object of the present invention to provide a new and improved string instrument bridge apparatus which is of a durable and reliable construction.

An even further object of the present invention is to provide a new and improved string instrument fret apparatus which is susceptible of a low cost of manufacture with regard to both materials and labor, and which accordingly is then susceptible of low prices of sale to the consuming public, thereby making such string instrument bridge apparatus economically available to the buying public.

Still yet another object of the present invention is to provide a new and improved string instrument bridge apparatus which provides in the apparatuses and methods of the prior art some of the advantages thereof, while simultaneously overcoming some of the disadvantages normally associated therewith.

Still another object of the present invention is to provide a new and improved string instrument bridge apparatus wherein the same is arranged for providing a properly oriented support surface for a player's fingers during playing of a string instrument.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a top orthographic view of a modified finger rest plate utilized by the instant invention.

FIG. 5 is an orthographic frontal view, taken in elevation, of the organization as illustrated in FIG. 4.

FIG. 6 is an orthographic side view of the organization.

FIG. 7 is an orthographic view, taken along the lines 7—7 of FIG. 6 in the direction indicated by the arrows.

DESCRIPTION OF THE PREFERRED EMBODIMENT

Figure 1:
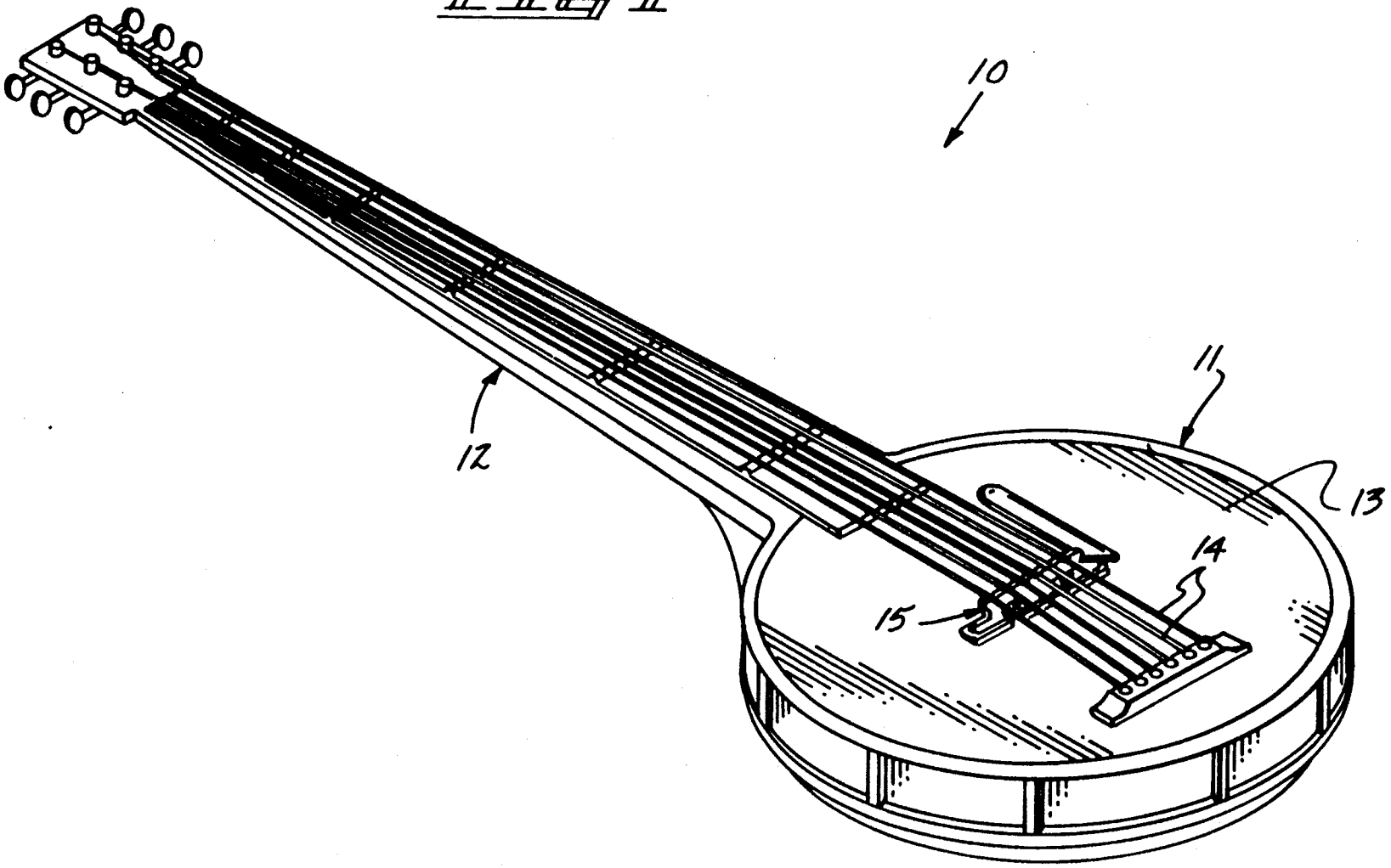
FIG. 1 is an isometric illustration of the instant invention.
Figure 2:
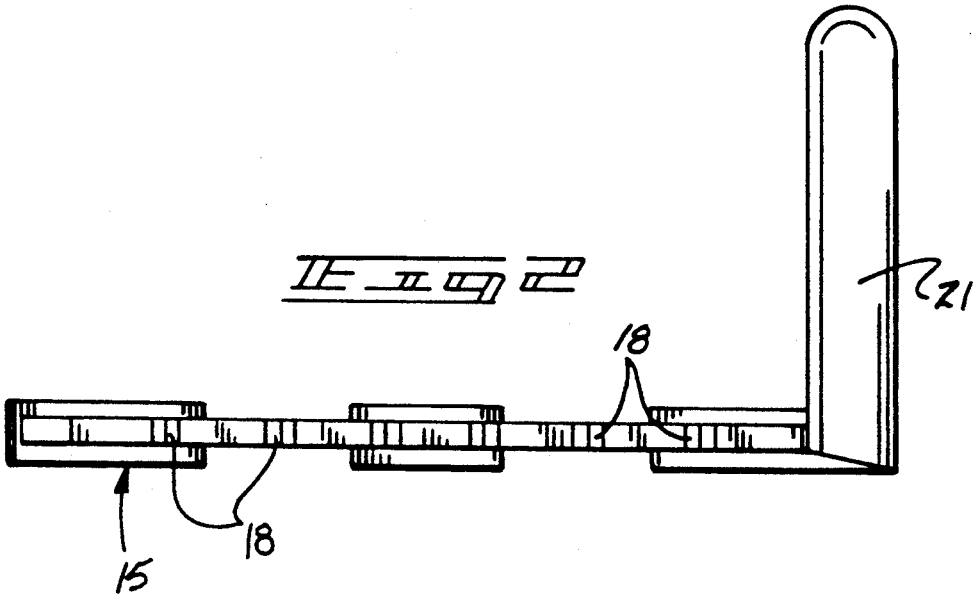
FIG. 2 is an orthographic top view of the instant invention in a removed relationship relative to an associated string instrument.
Figure 3:
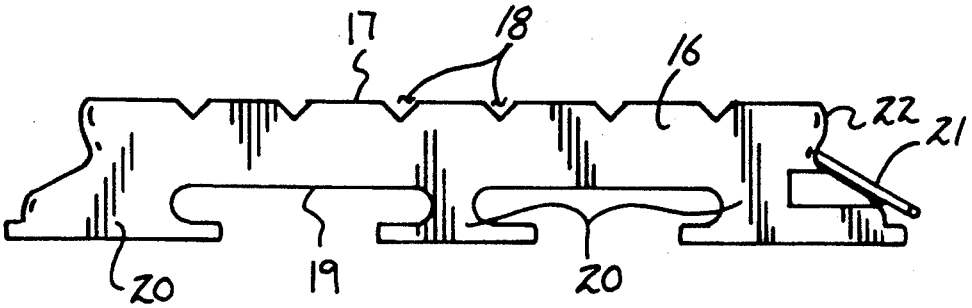
FIG. 3 is an orthographic frontal view, taken in elevation, of the organization as set forth in FIG. 2.

With reference now to the drawings, and in particular to FIGS. 1 to 9 thereof, a new and improved string instrument fret apparatus embodying the principles and concepts of the present invention and generally designated by the reference numeral 10 will be described.

More specifically, the string instrument fret apparatus 10 of the instant invention essentially comprises an instrument body 11, including a neck 12 mounted exteriorly of and diametrically aligned with the body 11, with the neck and body including a series of string members extending along the neck to the body, with the body 11 including a body top planar wall 13 of conventional construction. A fret member 15 is provided defined by a planar elongate body plate 16 orthogonally oriented relative to the body top planar wall 13. The plate 16 includes an upper edge 17 that includes a series of spaced notches 18, with each notch including a respective string member of the plurality of string members 14. A lower edge 19 is formed to the body plate 16, wherein the lower edge 19 is generally arranged parallel to the upper edge 17, with a plurality of spaced support legs 20 aligned with the body plate 16 and spaced apart a predetermined spacing. A finger rest plate 21 is mounted to a side plate edge 22, with the finger rest plate 21 orthogonally oriented relative to the body plate 16 and oriented medially of the side plate edge 22 between the upper edge 17 and the support legs 20. The side support plate 22 is further oriented at an acute included angle between the top of the plate 21 and the upper edge 17 of the body plate 16.

The modified finger rest plate 26, as utilized by the modified bridge structure 15*a* as set forth in FIGS. 4–7, includes a mounting block 24 fixedly secured to an upper end of a support leg extension 23 that is positioned at a lower terminal edge of the side plate edge 22. The mounting block 24 includes a lock fastener 25 mounted to a threaded boss 27 projecting through the mounting block 24 into the modified finger rest plate 26. The modified finger rest plate 26 includes a top "T" shaped groove 28 and a bottom "T" shaped groove 29, each arranged in a spaced parallel relationship to top and bottom surfaces of the modified finger rest plate 26, wherein the top "T" shaped groove 28 includes top flanges 28*a* spaced above a bottom surface of the top groove, and bottom flanges 29*a* spaced above and parallel a bottom surface of the bottom groove, wherein the top "T" shaped groove 28 mounts an abrasive insert plate 30 captured and mounted below the top flanges 28, wherein the bottom "T" shaped groove 29 includes a wax insert plate 31 mounted within the bottom "T" shaped groove 29 captured therewithin by the bottom flanges 29*a*. The use of abrasive and wax insert plates 30 or 31 by an individual permits the heightening of finger sensations or the adding of lubricity of the fingers during use of the associated instrument.

Figure 8B:
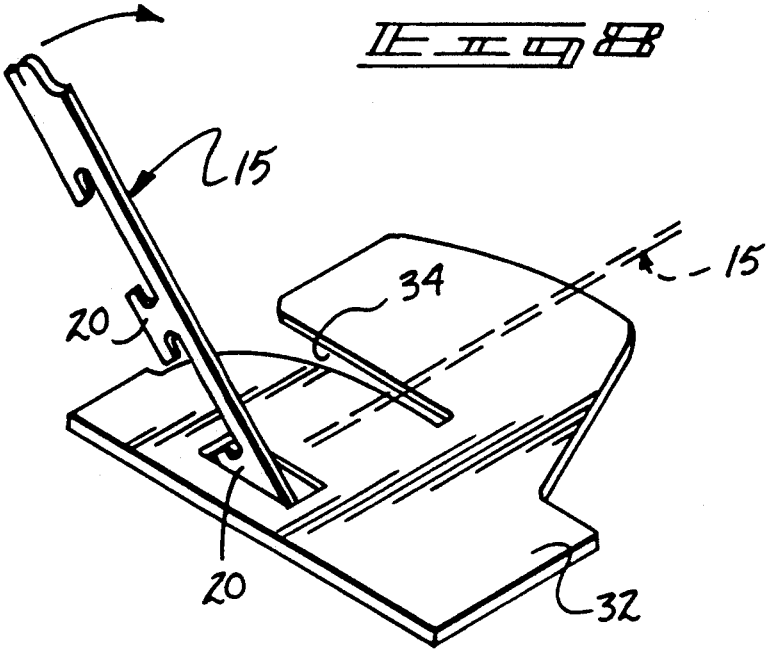
FIG. 8 is an isometric illustration of a further modified support plate structure for use in combination with a bridge member.
Figure 9:
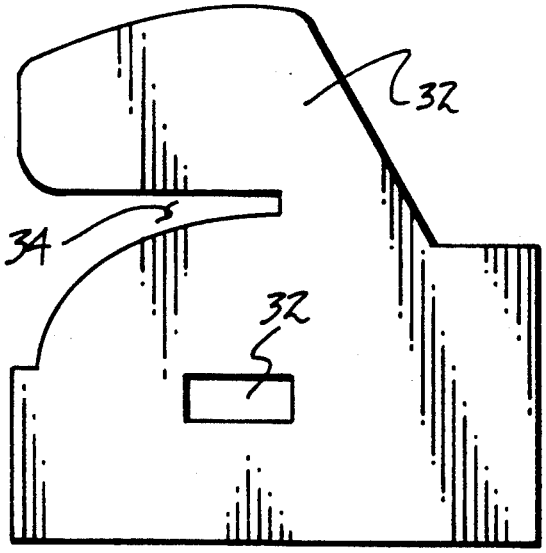
FIG. 9 is a top orthographic view of the support plate as illustrated in FIG. 8.

The organization, as illustrated in FIGS. 8 and 9, utilizes a polymeric foam plate 32 that is provided with a plate opening 33 spaced from a plate slot 34 through a lower terminal edge of the foam plate 32, wherein the opening 33 and slot 34 are spaced apart the predetermined spacing defined between a plurality of the support legs 20 such that the fret structure 15 is directed into the opening 33, rotated ninety degrees as illustrated in FIG. 8, wherein the adjacent support leg 20 is interfitted into the plate slot 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A string instrument bridge apparatus, comprising in combination, an instrument body, the instrument body including a body top planar wall, and further including an instrument neck member, the instrument neck member fixedly mounted to the instrument body, and a plurality of string members directed along the instrument neck over the body top planar wall, and a bridge member, the bridge member including a planar elongate body plate, wherein the planar elongate body plate includes an upper edge spaced above and parallel the body top planar wall, and the body plate including a lower edge spaced from and parallel the upper edge, and the upper edge including a plurality of spaced notches, each notch including a string member of the plurality of string members, and the lower edge including a plurality of spaced support legs, and the elongate body plate includes a side plate edge extending between the upper edge and the lower edge, and a finger rest plate, the finger rest plate mounted to the side plate edge, wherein the finger rest plate is orthogonally oriented relative to the elongate body plate, and the side plate edge includes a support leg extension extending longitudinally beyond the side plate edge, and a mounting block mounted on the support leg extension, and the mounting block including a threaded boss orthogonally directed thereto, the threaded boss including a lock fastener mounted to the threaded boss in cooperation with the mounting block, and the threaded boss longitudinally directed through the finger rest plate permitting selective rotation of the finger rest plate relative to the elongate body plate, and the elongate body plate includes a plate top surface and a plate bottom surface, the plate top surface includes a top "T" shaped groove coextensive with the plate top surface, and the plate bottom surface includes a bottom "T" shaped groove coextensive with the plate bottom surface, wherein the top "T" shaped groove is arranged parallel to the bottom "T" shaped groove, and wherein the top "T" shaped groove includes a plurality of top flanges arranged parallel to the bottom surface of the top "T" shaped groove, and the bottom "T" shaped groove includes a plurality of bottom flanges arranged parallel to a bottom surface of the bottom "T" shaped groove, and an abrasive insert plate mounted within the top "T" shaped groove under the top flanges, and a wax insert plate mounted within the bottom "T" shaped groove under the bottom flanges, wherein the top flanges capture the abrasive insert plate within the top "T" shaped groove, and the bottom flanges capture the wax insert plate within the bottom "T" shaped groove.

2. An apparatus as set forth in claim 1 wherein the elongate body plate includes a plate top surface and a plate bottom surface, the plate top surface includes a top "T" shaped groove coextensive with the plate top surface, and the plate bottom surface includes a bottom "T" shaped groove coextensive with the plate bottom surface, wherein the top "T" shaped groove is arranged parallel to the bottom "T" shaped groove, and wherein the top "T" shaped groove includes a plurality of top flanges arranged parallel to the bottom surface of the top "T" shaped groove, and the bottom "T" shaped groove includes a plurality of bottom flanges arranged parallel to a bottom surface of the bottom "T" shaped groove, and an abrasive insert plate mounted within the top "T" shaped groove under the top flanges, and a wax insert plate mounted within the bottom "T" shaped groove under the bottom flanges, wherein the top flanges capture the abrasive insert plate within the top "T" shaped groove, and the bottom flanges capture the wax insert plate within the bottom "T" shaped groove.

* * * * *